US010053639B2

(12) United States Patent
Shih et al.

(10) Patent No.: US 10,053,639 B2
(45) **Date of Patent: *Aug. 21, 2018**

(54) PRODUCTION OF LOW CLOUD POINT DIESEL FUELS AND LOW FREEZE POINT JET FUELS

(71) Applicant: ExxonMobil Research and Engineering Company, Annandale, NJ (US)

(72) Inventors: Stuart S. Shih, Gainesville, VA (US); Xiaochun Xu, Annandale, NJ (US); William J. Novak, Bedminster, NJ (US); Carlos N. Lopez, Amissville, VA (US); Timothy Lee Hilbert, Fairfax, VA (US); Stephen John McCarthy, Center Valley, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 161 days.

This patent is subject to a terminal disclaimer.

(21) Appl. No.: 14/506,790

(22) Filed: Oct. 6, 2014

(65) Prior Publication Data

US 2015/0122701 A1 May 7, 2015

Related U.S. Application Data

(60) Provisional application No. 61/899,433, filed on Nov. 4, 2013.

(51) Int. Cl.
*C10G 67/00* (2006.01)
*C10G 67/02* (2006.01)
(Continued)

(52) U.S. Cl.
CPC ..... *C10G 67/02* (2013.01); *C10G 45/02* (2013.01); *C10G 45/06* (2013.01); *C10G 45/08* (2013.01);
(Continued)

(58) Field of Classification Search
CPC ..... C10G 45/62; C10G 45/64; C10G 65/043; C10G 2300/1048; C10G 2300/304;
(Continued)

(56) References Cited

U.S. PATENT DOCUMENTS 6,204,426 B1 * 3/2001 Miller ..... C10L 1/08 208/27
8,303,804 B2 11/2012 Helton et al.
(Continued)

FOREIGN PATENT DOCUMENTS

EP 1 063 014 * 12/2000
WO 2009085257 A1 7/2009
WO 2010077345 A1 7/2010

OTHER PUBLICATIONS

PCT Application No. PCT/US2014/059999, Communication from the International Searching Authority, Forms PCT/ISA/220, PCT/ISA/210 and PCT/ISA/237, dated Apr. 7, 2015, 11 pages.

*Primary Examiner* — Prem C Singh
*Assistant Examiner* — Brandi M Doyle
(74) *Attorney, Agent, or Firm* — Andrew T. Ward; Jamie Sullivan

(57) ABSTRACT

Methods are provided for dewaxing a distillate fuel boiling range feed to improve one or more cold flow properties of the distillate fuel feed, such as cloud point, where the distillate fuel feed is fractionated to produce both a jet fuel product and an arctic diesel fuel product. The decrease of cloud point is achieved by using a feedstock having a concentration of nitrogen of less than about 50 wppm and a
(Continued)

concentration of sulfur of less than about 15 wppm. Further, the dewaxing catalyst may have a reduced content of hydrogenation metals, such as a content of Pt or Pd of from about 0.05 wt % to about 0.35 wt %. A distillate fuel feed can be dewaxed to achieve a desired cloud point differential using a reduced metals content dewaxing catalyst under the same or similar conditions to those required for a dewaxing catalyst with higher metals content.

17 Claims, 2 Drawing Sheets

(51) Int. Cl.

| | |
|---|---|
| ***C10G 45/02*** | (2006.01) |
| ***C10G 45/06*** | (2006.01) |
| ***C10G 45/08*** | (2006.01) |
| ***C10G 45/10*** | (2006.01) |
| ***C10G 45/12*** | (2006.01) |
| ***C10G 45/62*** | (2006.01) |
| ***C10G 45/64*** | (2006.01) |
| ***C10G 65/04*** | (2006.01) |

(52) U.S. Cl.
CPC ..... *C10G 45/10* (2013.01); *C10G 45/12* (2013.01); *C10G 45/62* (2013.01); *C10G 45/64* (2013.01); *C10G 65/043* (2013.01); *C10G 2300/1051* (2013.01); *C10G 2300/1055* (2013.01); *C10G 2300/1059* (2013.01); *C10G 2300/202* (2013.01); *C10G 2400/04* (2013.01); *C10G 2400/08* (2013.01)

(58) Field of Classification Search
CPC ..... C10G 2400/04; B01J 29/7461; B01J 29/7492; B01J 35/1004; B01J 2229/42
See application file for complete search history.

(56) References Cited

U.S. PATENT DOCUMENTS

| | | | | |
|---|---|---|---|---|
| 8,377,286 | B2 | 2/2013 | Oliveri et al. | |
| 2006/0006098 | A1* | 1/2006 | Espinoza | C10G 63/04 208/15 |
| 2006/0016722 | A1 | 1/2006 | Espinoza et al. | |
| 2009/0127165 | A1* | 5/2009 | Eijsbouts-Spickova | B01J 23/002 208/216 R |
| 2010/0084313 | A1* | 4/2010 | Helton | C10G 3/00 208/60 |
| 2010/0326881 | A1* | 12/2010 | Lopez | C10G 45/08 208/15 |
| 2011/0315599 | A1* | 12/2011 | Prentice | C10G 45/06 208/66 |
| 2012/0004477 | A1 | 1/2012 | Dougherty et al. | |
| 2013/0112594 | A1 | 5/2013 | Shih et al. | |
| 2014/0291202 | A1 | 10/2014 | Xu et al. | |

* cited by examiner

PRODUCTION OF LOW CLOUD POINT DIESEL FUELS AND LOW FREEZE POINT JET FUELS

CROSS REFERENCE TO RELATED APPLICATION

This application relates and claims priority to U.S. Provisional Patent Application No. 61/899,433, filed on Nov. 4, 2013.

FIELD OF THE INVENTION

This invention is related to hydroprocessing of distillate feeds to form jet fuels and low cloud point diesel fuels.

BACKGROUND OF THE INVENTION

In diesel hydroprocessing, it is sometimes beneficial to include a dewaxing stage as part of reaction train in order to improve properties of the resulting diesel fuel such as pour point or cloud point. Such improvements in cold flow properties can, for example, allow a diesel fuel to meet a desired specification for a diesel fuel pool, or the improvements can allow a diesel fuel to be suitable for a higher value use, such as use as a winter diesel fuel. While such improvements can be desirable, performing an additional dewaxing process on a diesel fuel product typically means that additional refinery resources are consumed in order to perform the process.

U.S. Pat. No. 8,377,286 describes hydroprocessing methods for diesel fuel production. The methods include options for processing diesel fuel under sour conditions, such as in the presence of 100 wppm or more of sulfur. The dewaxing catalysts used for dewaxing of the diesel fuel include catalysts with a relatively low surface area, such as catalysts with a ratio of zeolite surface area to external surface area of at least about 80:100. The dewaxing catalysts are described as having a hydrogenation metals content of at least 0.1 wt %.

U.S. Pat. No. 8,303,804 describes hydroprocessing methods for production of jet fuels. The methods can include exposing a kerosene boiling range feedstock to a 10-member ring zeolite catalyst that also includes 0.1 wt % of a metal hydrogenation component.

SUMMARY OF THE INVENTION

In an embodiment, a method for producing a diesel fuel product and a jet fuel product from a single feedstock is provided. The method includes exposing a distillate fuel boiling range feedstock having a sulfur content of less than about 10 wppm and a nitrogen content of less than about 5 wppm to a dewaxing catalyst comprising a molecular sieve and a Group VIII noble metal hydrogenation component under effective dewaxing conditions to produce a dewaxed effluent having a cloud point that is reduced by at least about 25° F. (14° C.) relative to a feedstock cloud point. The method also includes fractionating the dewaxed effluent to produce at least a diesel fuel product having a cloud point of about −4° F. (−20° C.) or less and a distillate product having a lower boiling range than the diesel fuel product, a fractionation cut point temperature between the distillate product having the lower boiling range and the diesel fuel product being at least 500° F. (260° C.).

In another embodiment, a method for producing a diesel fuel product and a jet fuel product from a single feedstock is provided. The method includes exposing a distillate fuel boiling range feedstock having a sulfur content of less than about 15 wppm and a nitrogen content of less than about 50 wppm to a dewaxing catalyst comprising a 10-member ring 1-D molecular sieve and a metal hydrogenation component under effective dewaxing conditions to produce a dewaxed effluent, wherein the dewaxing catalyst has an amount of metal hydrogenation component comprising about 0.05 wt % to about 0.35 wt % of a Group VIII noble metal, and wherein the dewaxed effluent, when fractionated, produces the diesel fuel product and the jet fuel product. The method further includes fractionating the dewaxed effluent to produce at least a diesel fuel product having a cloud point of about 14° F. (−10° C.) or less and a jet fuel product having a lower boiling range than the diesel fuel product, a fractionation cut point temperature between the diesel fuel product and the jet fuel product having the lower boiling range being at least 500° F. (260° C.).

DETAILED DESCRIPTION OF THE EMBODIMENTS

Overview

Figure 1:
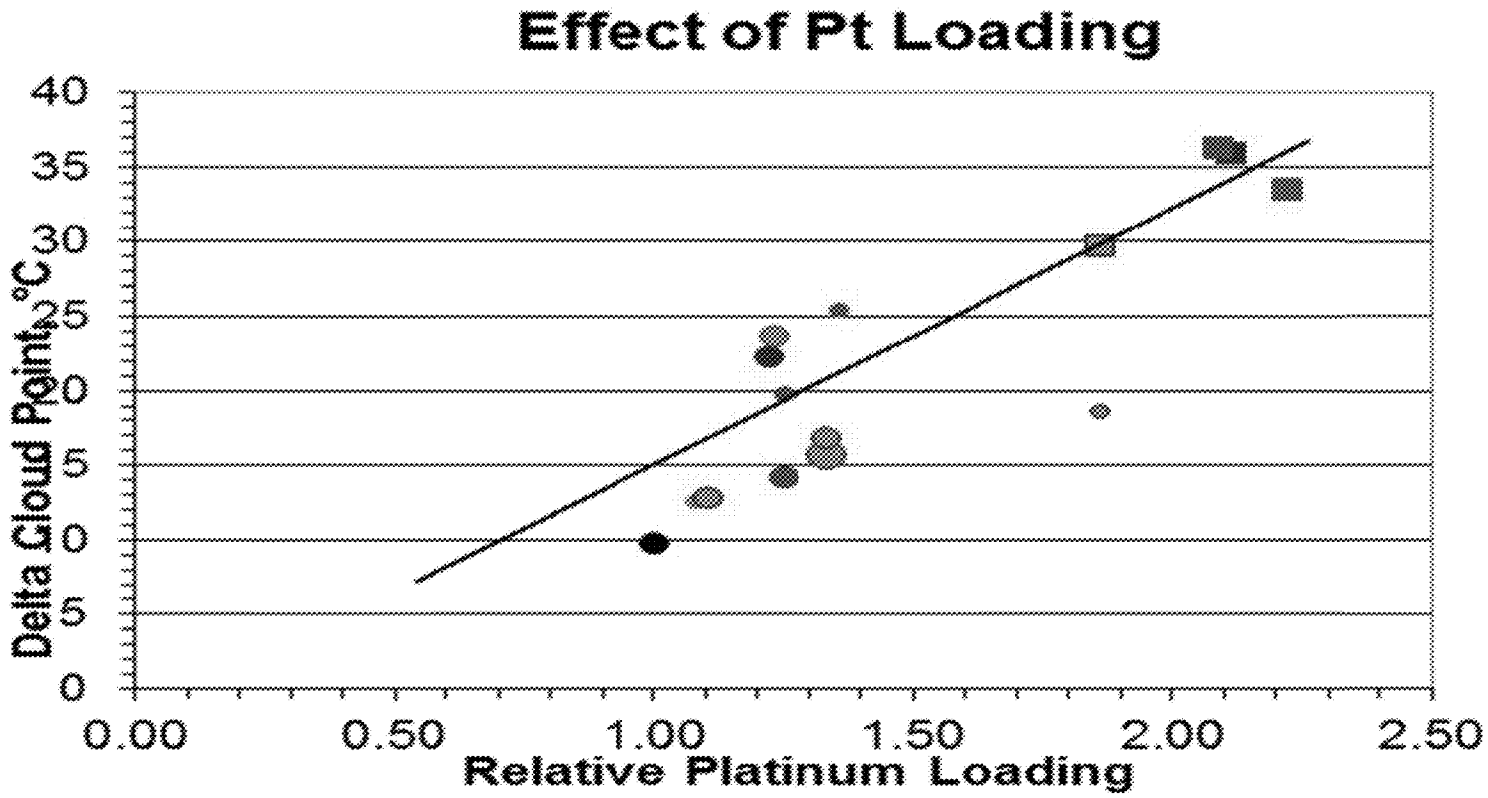
FIG. 1 shows an example of the dependence of dewaxing catalyst activity for cloud point reduction relative to metals content.

In various aspects, methods are provided for dewaxing a distillate fuel boiling range feed to improve one or more cold flow properties of the distillate fuel feed, such as cloud point. The dewaxing of the distillate feed can be performed using a feedstock having low amounts of sulfur and nitrogen, such as less than about 15 wppm sulfur, or less than about 10 wppm sulfur, and less than about 50 wppm nitrogen, or less than about 5 wppm nitrogen. Because of the low amounts of sulfur and nitrogen in the feedstock, a diesel fuel product having a cloud point of about −10° C. or less and a jet fuel product having a lower boiling range than the diesel fuel product are produced. Further, the dewaxing of the distillate feed can be performed using a dewaxing catalyst with a reduced content of hydrogenation metals, such as a content of Pt or Pd of from about 0.03 wt % to about 0.35 wt %. In some aspects, a distillate fuel feed can be dewaxed to achieve a desired cloud point differential and to produce both an arctic diesel product and a jet fuel product using a reduced metals content dewaxing catalyst under the same or similar conditions to those required for a dewaxing catalyst with higher metals content.

As mentioned, significant cloud point reductions can be achieved when the nitrogen and sulfur concentrations in the feedstock are low. For instance, the sulfur concentration in the feedstock may be less than about 15 wppm, such as less than about 10 wppm, or less than about 5 wppm. The nitrogen concentration in the feedstock may be less than about 50 wppm, such as less than about 25 wppm, or less than about 5 wppm, or less than about 1 wppm. Not only is the cloud point reduction significant, but this allows for the simultaneous production of a jet fuel product and a diesel product. In some embodiments, the diesel product is suitable for an arctic diesel application, which requires a cloud point as low as −34° C. Cloud point reductions of at least about 10° C., or at least about 40° C., or at least about 60° C., or at least about 80° C., or at least about 100° C., or at least about 120° C. are possible when the feedstock properties are as described herein. In addition to the cloud point reduction, embodiments described herein allow for jet fuels with low freeze points, such as less than −40° C., to be produced. While the EN590 Arctic Diesel Specifications specify that a Class 0 diesel fuel product must have a cloud point of at least −10° C., arctic diesel fuel products produced by way of embodiments of the present invention allow for cloud points to drop as low as at least about −10° C., such as at least about −20° C., or at least about −60° C., or at least about −70° C. The cloud point reductions described herein are significant and even unexpected based on traditional processes of producing dewaxed effluents. The significant cloud point reductions are produced when the feedstock has low concentrations of both nitrogen and sulfur as described herein such that both arctic diesel fuel products and low freeze point jet fuel products are produced simultaneously.

FIG. 1 shows an example of the expected relationship for how the metals content of a dewaxing catalyst impacts the amount of cloud point differential. In FIG. 1, a variety of dewaxing catalysts with varying metals content were used to dewax a distillate fuel feed under a fixed set of conditions. The dewaxing catalyst shown in FIG. 1 corresponds to an alumina-bound ZSM-48 catalyst with a silica to alumina ratio between about 70 to about 110, with various amounts of Pt supported on the catalyst. For ease of comparison, a metals content of 0.6 wt % Pt supported on the dewaxing catalyst was selected as a baseline amount of metal. The amount of supported metals (Pt) on the other catalysts in FIG. 1 is shown as a relative ratio to the baseline amount.

For the data in FIG. 1, the feed was a commercially generated diesel fuel that was spiked with 3000 wppm of sulfur using DMDS and 50 wppm of nitrogen using aniline. The spiked diesel fuel was exposed to the dewaxing catalyst at a liquid hourly space velocity of about 1.8 $hr^{-1}$, an $H_2$ pressure of about 800 psig (5.5 MPag), and an ($H_2$) treat gas flow rate of about 2000 scf/b (337 $Nm^3/m^3$).

As shown in FIG. 1, the amount of cloud point reduction achieved has an approximately linear relationship with the amount of hydrogenation metal supported on the dewaxing catalyst. At lower values of metal content, such as near 0.6 wt % Pt or 1.0 for the relative ratio on the x-axis, the cloud point differentials shown in FIG. 1 are slightly below the curve fit to all of the data. However, even for the lower metals content data points, the linear relationship between metals content and cloud point differential is readily apparent. This demonstrates that performing dewaxing on a distillate fuel feed in the presence of a dewaxing catalyst with a reduced metals content would be expected to result in a smaller cloud point differential as compared to performing dewaxing under similar conditions with a higher metals content catalyst.

In contrast to the trend shown in FIG. 1, it has been unexpectedly found that a dewaxing catalyst with a hydrogenation metal content of about 0.35 wt % or less, such as about 0.3 wt % or less, can be used to achieve the same cloud point reduction as a higher metals content dewaxing catalyst under similar processing conditions. In addition to requiring a lower metal content, the dewaxing catalyst with a metal content of about 0.35 wt % or less, such as about 0.3 wt % or less, also consumes less hydrogen while achieving the same cloud point reduction. Without being bound by any particular theory, it is believed that the reduced hydrogen consumption is due to the lower metal content dewaxing catalyst performing less aromatic saturation of the distillate fuel feedstock.

Feedstocks

In some aspects, a distillate fuel boiling range feedstock can have an initial boiling point of at least about 200° F. (93° C.), or at least about 250° F. (121° C.), or at least about 300° F. (149° C.), or at least about 350° F. (177° C.), or at least about 400° F. (204° C.), or at least about 450° F. (232° C.). The initial boiling point can vary widely, depending on how much kerosene or other lighter distillate components are included in a feedstock. In another embodiment, the feedstock can have a final boiling point of about 800° F. (427° C.) or less, or about 700° F. (371° C.) or less, or about 650° F. (343° C.) or less. Another way of characterizing a feedstock is based on the boiling point required to boil a specified percentage of the feed. For example, the temperature required to boil at least 5 wt % of a feed is referred to as a "T5" boiling point. When characterizing a feed based on a T5 boiling point, the feedstock can have a T5 boiling point at least about 200° F. (93° C.), or at least about 250° F. (121° C.), or at least 280° F. (138° C.), or at least about 300° F. (149° C.), or at least about 350° F. (177° C.), or at least about 400° F. (204° C.), or at least about 450° F. (232° C.). In some aspects, the feedstock can correspond to a diesel boiling range feedstock that has a T5 boiling point of at least about 350° F. (177° C.), such as at least about 370° F. (188° C.), or at least about 400° F. (204° C.), or at least about 450° F. (232° C.). In another aspect, the feed can have a T95 boiling point of about 800° F. (427° C.) or less, or about 750° F. (399° C.) or less, or about 700° F. (371° C.) or less, or about 650° F. (343° C.) or less. The boiling point for a feed at a given weight percentage can be determined by any convenient method, such as the method specified in D2887.

In some aspects, the feedstock generally comprises a mineral oil. By "mineral oil" is meant a fossil/mineral fuel source, such as crude oil, and not the commercial organic product, such as sold under the CAS number 8020-83-5, e.g., by Aldrich. Examples of mineral oils can include, but are not limited to, straight run (atmospheric) gas oils, demetallized oils, coker distillates, cat cracker distillates, heavy naphthas, diesel boiling range distillate fraction, jet fuel boiling range distillate fraction, and/or kerosene boiling range distillate fractions. The mineral oil portion of the feedstock can comprise any one of these example streams or any combination thereof. Preferably, the feedstock does not contain any appreciable asphaltenes.

Mineral feedstreams suitable for use in various embodiments can have a nitrogen content from about <1.0 wppm to about 6000 wppm nitrogen, such as at least about 50 wppm or at least about 100 wppm and/or about 2000 wppm or less or about 1000 wppm or less. In an embodiment, feedstreams suitable for use herein can have a sulfur content from about 1 wppm to about 40,000 wppm sulfur, such as about 100 wppm to about 30,000 wppm, or about 250 wppm to about 25,000 wppm. In embodiments where an arctic diesel product (e.g., diesel product with a very low cloud point, such as less than −10° C.) and a jet fuel product are to be produced from the same feedstock, a sweet feed, or a feedstock containing very low amounts of sulfur and nitrogen, may be used where the nitrogen content of the feedstock is less than 50 wppm, or in some embodiments, less than 1 wppm, and the sulfur content of the feedstock is less than 10 wppm or even less than 3 wppm. Depending on the aspect, a feed can be hydrotreated prior to dewaxing to reduce the amount of sulfur and/or nitrogen content that a dewaxing catalyst is exposed to. In such embodiments, performing a separation between the hydrotreating and dewaxing stages may be desirable. Either with or without such hydrotreating, in some aspects the sulfur content of a distillate fuel boiling range feedstock can be about 5000 wppm or less, such as about 1000 wppm or less, or about 500 wppm or less, or about 400 wppm or less, or about 100 wppm or less. In such aspects, the nitrogen content of the distillate fuel boiling range feedstock can be about 500 wppm or less, such as about 100 wppm or less, or about 65 wppm or less, or about 50 wppm or less.

A distillate fuel boiling range feed can typically have an aromatics content of at least about 3 wt %, such as at least about 5 wt/o, or at least about 10 wt %. By reducing or minimizing the amount of additional saturation of such aromatics that is performed during dewaxing, the amount of hydrogen consumed during dewaxing can be reduced.

In various aspects of the invention, the feed can also include portions of the feed that are from biocomponent sources. The feed can include varying amounts of feedstreams based on biocomponent sources, such as vegetable oils, animal fats, fish oils, algae oils, etc. For a biocomponent feed that has been previously hydroprocessed or that is otherwise compatible with conventional refinery equipment, the feed could potentially be entirely derived from a biocomponent source. More typically, the feed can include at least 0.1 wt % of feed based on a biocomponent source, or at least 0.5 wt %, or at least 1 wt %, or at least 3 wt %, or at least 10 wt %, or at least 15 wt %. In such embodiments, the feed can include 90 wt % or less of a feed based on a biocomponent source, or 60 wt % or less, or 40 wt % or less, or 20 wt % or less. In other embodiments, the amount of co-processing can be small, with a feed that includes at least 0.5 wt % of feedstock based on a biocomponent source, or at least 1 wt %, or at least 2.5 wt %, or at least 5 wt %. In such an embodiment, the feed can include 20 wt % or less of biocomponent based feedstock, or 15 wt % or less, or 10 wt % or less, or 5 wt % or less.

In this discussion, a biocomponent feed or feedstock refers to a hydrocarbon feedstock derived from a biological raw material component, such as vegetable fats/oils or animal fats/oils, fish oils, pyrolysis oils, and algae lipids/oils, as well as components of such materials, and in some embodiments can specifically include one or more types of lipid compounds. A biocomponent portion of a feed can be a portion that has been previously hydroprocessed, a portion that has not been previously hydroprocessed, or a combination thereof.

Catalyst for Distillate Fuel Dewaxing

In some aspects, catalytic dewaxing with a low metals content dewaxing catalyst can be accomplished by selective hydrocracking and/or by isomerizing long chain molecules within a feed such as a diesel range feed. Dewaxing catalysts can be selected from molecular sieves such as crystalline aluminosilicates (zeolites) or silico-aluminophosphates (SAPOs). In an embodiment, the molecular sieve can be a 1-D or 3-D molecular sieve. In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite). ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23.

Optionally, the dewaxing catalyst can include a binder for the molecular sieve, such as alumina, titania, silica, silica-alumina, zirconia, or a combination thereof. In a preferred embodiment, the binder can be alumina. In another embodiment, the binder can be alumina, titania, or a combination thereof. In still another embodiment, the binder can be titania, silica, zirconia, or a combination thereof. Optionally, the binder can correspond to a binder with a relatively high surface area. One way to characterize the surface of the binder is in relation to the surface area of the molecular sieve in the dewaxing catalyst. For example, the ratio of molecular sieve surface area to binder surface can be about 80 to 100 or less, such as about 70 to 100 or less or about 60 to 100 or less.

One feature of molecular sieves that can impact the activity of the molecular sieve is the ratio of silica to alumina in the molecular sieve. In an embodiment where the molecular sieve is ZSM-48, the molecular sieve can have a silica to alumina ratio of less than about 200:1, such as less than about 110:1, or less than about 100:1, or less than about 90:1, or less than about 75:1. In various embodiments, the ratio of silica to alumina can be from 50:1 to 200:1, such as 60:1 to 160:1, or 70:1 to 100:1.

The dewaxing catalyst can also include a metal hydrogenation component, such as a Group VIII metal (Groups 8-10 of IUPAC periodic table). Suitable Group VIII metals can include Pt, Pd, or Ni. Preferably the Group VIII metal is a noble metal, such as Pt, Pd, or a combination thereof. The amount of metal in the catalyst can be at least 0.03 wt % based on catalyst, or at least 0.06 wt %, or at least 0.1 wt %, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.05 to 0.35 wt %, or from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

Catalytic dewaxing can be performed by exposing a feedstock to a dewaxing catalyst under effective (catalytic)

dewaxing conditions. Process conditions in a catalytic dewaxing zone in a sour environment can include a temperature of from 320 to 450° C., preferably 321 to 400° C., a hydrogen partial pressure of from 1.8 MPag to 34.6 MPag (250 psig to 5000 psig), preferably 4.8 MPag to 20.8 MPag, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of about 610° F. (321° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF/B to 6000 SCF/B). These latter conditions may be suitable, for example, if the dewaxing stage is operating under sour conditions. The liquid hourly space velocity can vary depending on the relative amount of hydrocracking catalyst used versus dewaxing catalyst. Relative to the combined amount of hydrocracking and dewaxing catalyst, the LHSV can be from about 0.2 $h^{-1}$ to about 10 $h^{-1}$, such as from about 0.5 $h^{-1}$ to about 5 $h^{-1}$ and/or from about 1 $h^{-1}$ to about 4 $h^{-1}$. Depending on the relative amount of hydrocracking catalyst and dewaxing catalyst used, the LHSV relative to only the dewaxing catalyst can be from about 0.25 $h^{-1}$ to about 50 $h^{-1}$, such as from about 0.5 $h^{-1}$ to about 20 $h^{-1}$, and preferably from about 1.0 $h^{-1}$ to about 3.9 $h^{-1}$.

Based on dewaxing under effective catalytic dewaxing conditions, the cloud point of a dewaxed distillate fuel fraction can be reduced relative to the feedstock by at least about 10° F. (5° C.), such as at least about 40° F. (11° C.), or at least about 30° F. (17° C.). Additionally or alternately, in an aspect where the feedstock is hydrotreated prior to dewaxing, the cloud point of a dewaxed distillate fuel fraction can be reduced relative to the hydrotreated effluent by at least about 10° C., such as at least about 40° C., or at least about 60° C., or at least about 80° C., or at least about 100° C., or at least about 120° C. The amount of cloud point reduction can depend on a variety of factors, including the sulfur content of the feedstock, the nitrogen content of the feedstock, and the selected effective dewaxing conditions.

In one aspect, based on dewaxing under effective catalytic dewaxing conditions, the cloud point of a dewaxed distillate fuel fraction can be reduced relative to the feedstock even more when the nitrogen content and the sulfur content are low. For instance, a feedstock having a sulfur content of less than 15 wppm and a nitrogen content of less than 50 wppm may result in a dewaxed distillate fuel fraction having a cloud point reduction relative to the feedstock of at least about 45° F. (25° C.). Alternatively, a feedstock having a sulfur content of less than 5 wppm and a nitrogen content of less than 1 wppm may result in a dewaxed distillate fuel fraction having a cloud point reduction relative to the feedstock by at least about 100° F. (56° C.), such as at least about 110° F. (61° C.), such as at least about 120° F. (67° C.), such as at least about 130° F. (72° C.), or at least about 140° F. (78° C.). In one aspect, the dewaxed distillate fuel fraction having the reduced cloud point is a winter diesel fuel product. In another embodiment, the dewaxed distillate fuel fraction is a jet fuel product.

In various aspects, the amount of cloud point reduction for a dewaxing catalyst having 0.35 wt % or less of metal hydrogenation component can be within 10% of the amount of cloud point reduction produced when the same feedstock is exposed to a dewaxing catalyst comprising the same molecular sieve under substantially the same dewaxing conditions, but at least twice the amount of metal hydrogenation component. In other words, if the catalyst with at least twice as much metal produces a cloud point reduction of 20° F. in the dewaxed feedstock, then the catalyst having 0.35 wt % or less of metal hydrogenation component with produce a cloud point reduction of at least about 18° F. Unexpectedly, the catalyst having 0.35 wt % or less of metal hydrogenation component consume less hydrogen while achieving the same or a similar cloud point reduction. For example, the hydrogen consumption for the catalyst having 0.35 wt % or less of metal hydrogenation component can be at least about 5% lower than the consumption for the dewaxing catalyst having at least twice the metal hydrogenation component, such as at least about 7.5% lower, or at least about 10% lower.

Hydrotreatment and/or Hydrofinishing

Hydrotreatment is typically used to reduce the sulfur, nitrogen, and aromatic content of a feed. The catalysts used for hydrotreatment of the heavy portion of the crude oil from the flash separator can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

The reaction conditions can include an LHSV of 0.3 to 5.0 $hr^{-1}$, a total pressure from about 200 psig (1.4 MPag) to about 3000 psig (20.7 MPa), a treat gas containing at least about 80% hydrogen (remainder inert gas), and a temperature of from about 500° F. (260° C.) to about 800° F. (427° C.). Preferably, the reaction conditions include an LHSV of from about 0.5 to about 1.5 $hr^{-1}$, a total pressure from about 700 psig (4.8 MPa) to about 2000 psig (13.8 MPa), and a temperature of from about 600° F. (316° C.) to about 700° F. (399° C.). The treat gas rate can be from about 100 SCF/B (17 $Nm^3/m^3$) to about 10000 SCF/B (1685 $Nm^3/m^3$) of hydrogen, depending on various factors including the nature of the feed being hydrotreated. Note that the above treat gas rates refer to the rate of hydrogen flow. If hydrogen is delivered as part of a gas stream having less than 100% hydrogen, the treat gas rate for the overall gas stream can be proportionally higher. Hydrogen can be supplied co-currently with the input feed to the hydrotreatment reactor and/or reaction zone or separately via a separate gas conduit to the hydrotreatment zone.

In some aspects of the invention, the hydrotreatment stage(s) can reduce the sulfur content of the feed to a suitable level. For example, the sulfur content can be reduced sufficiently so that the feed into the dewaxing stage can have about 500 wppm sulfur or less, or about 250 wppm or less, or about 100 wppm or less, or about 50 wppm or less. Additionally or alternately, the sulfur content of the feed to the dewaxing stage can be at least about 1 wppm sulfur, or at least about 5 wppm, or at least about 10 wppm. Additionally or alternately, the sulfur content of the hydrotreated effluent can correspond to any of the other sulfur values noted above.

The catalyst in a hydrotreatment stage can be a conventional hydrotreating catalyst, such as a catalyst composed of a Group VIB metal (Group 6 of IUPAC periodic table) and/or a Group VIII metal (Groups 8-10 of IUPAC periodic table) on a support. Suitable metals include cobalt, nickel, molybdenum, tungsten, or combinations thereof. Preferred combinations of metals include nickel and molybdenum or nickel, cobalt, and molybdenum. Suitable supports include silica, silica-alumina, alumina, and titania.

After hydrotreatment, the hydrotreated effluent can optionally but preferably be separated, such as by separating the gas phase effluent from a liquid phase effluent, in order to remove gas phase contaminants generated during hydrotreatment. Alternatively, in some aspects the entire hydrotreated effluent can be cascaded into the catalytic dewaxing stage(s).

Optionally, a hydrofinishing stage can also be included after the catalytic dewaxing stage(s), such as in the final catalytic dewaxing reactor or in a separate reactor. Hydrofinishing catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from about 125° C. to about 425° C., or about 180° C. to about 280° C., a total pressure from about 200 psig (1.4 MPa) to about 800 psig (5.5 MPa), or about 400 psig (2.8 MPa) to about 700 psig (4.8 MPa), and a liquid hourly space velocity from about 0.1 $hr^{-1}$ to about 5 $hr^{-1}$ LHSV, preferably about 0.5 $hr^{-1}$ to about 1.5 $hr^{-1}$. The treat gas rate can be selected to be similar to a catalytic dewaxing stage, similar to a hydrotreatment stage, or any other convenient selection.

Fractionation

In various embodiments, at least two fuel products can be made from a feedstock. The fuel product can include one or more transportation fuels, such as gasoline, kerosene, jet fuel, and/or diesel, and these individual fuels can typically be separated into their component parts by fractionation. The dewaxed effluent produced by methods described herein can be separated to form at least a first fuel product and a second fuel product. In embodiments, the first fuel product has a lower boiling range than the second fuel product. For example, in one embodiment, the first fuel product is a jet fuel product and the second fuel product is a diesel fuel product, such as an arctic diesel fuel product. Such a separation can be performed, for example, using a distillation unit, such as an atmospheric distillation unit. One method for determining the amounts in the various portions is by selecting distillation cut point temperatures. The distillation cut point temperatures may vary depending on the nature of the dewaxed effluent. Generally, the distillation cut point between the first fuel product and the second fuel product can be between about 500° F. (260° C.) and 650° F. (343° C.), such as at least about 545° F. (285° C.), or at least about 590° F. (310° C.), or at least about 600° F. (316° C.), or at least about 625° F. (329° C.). For instance, in one embodiment, the cut point between the jet fuel product and the diesel fuel product is about 609° F. (321° C.). In some embodiments, a plurality of distillation cut points can be used to form a plurality of distillate fuel fractions, with the highest distillation cut point temperature corresponding to separation of a higher boiling diesel fuel fraction from a lower boiling distillate fuel fraction, such as a diesel fuel or jet fuel fraction.

Another way of defining a dewaxed effluent and/or a product fraction formed from the dewaxed effluent is based on the boiling range of the effluent. One option for defining a boiling range is to use an initial boiling point for a product and/or a final boiling point for a product, similar to the method for defining initial and/or final boiling points for feeds as described above. Another option, which in some instances may provide a more representative description of a dewaxed effluent, or one of its fractionated products, is to characterize a dewaxed effluent or product fraction based on the amount of the effluent or product fraction that boils at one or more temperatures. For example, a "T5" boiling point for a dewaxed effluent or a product fraction is defined as the temperature at which 5 wt % of the effluent or product fraction will boil off. Similarly, a "T95" boiling point is a temperature at 95 wt % of the effluent or product fraction will boil.

The dewaxed effluent produced by embodiments described herein may be separated or fractionated to form at least a diesel fuel product and a jet fuel product. In embodiments, the diesel fuel product may have a T5 boiling point of at least about 500° F. (260° C.), or at least about 550° F. (288° C.), or at least about 600° F. (316° C.). Such a diesel fuel product can have a cloud point of about −10° C., such as about −20° C. or less, or about −60° C. or less, or about −70° C. or less.

Sample Configurations

Figure 2:
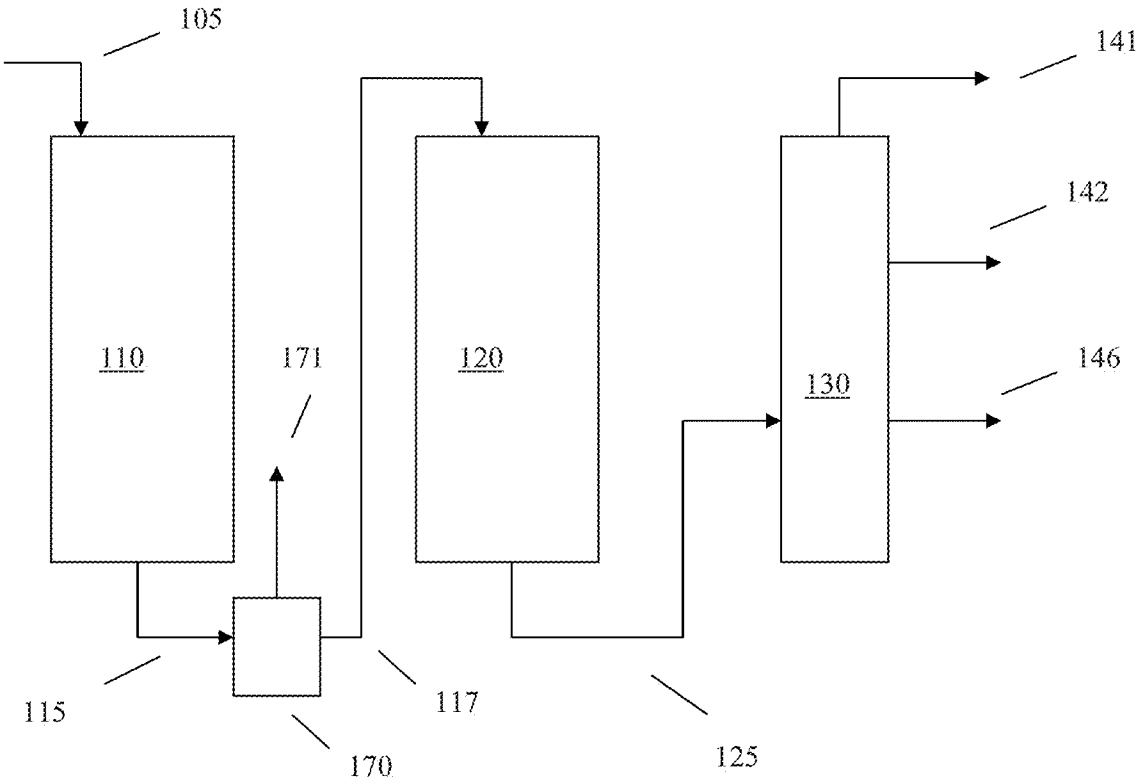
FIG. 2 schematically shows an example of a reaction system suitable for performing an embodiment of the invention.

FIG. 2 shows an example of a two stage reaction system for producing a diesel product. In FIG. 2, a suitable feed 105 for forming a distillate fuel boiling range product (such as a diesel boiling range product) is passed into a hydrotreatment reactor 110. A separate hydrogen feed (not shown) can also be introduced into the reactor, or hydrogen can be introduced along with the feed. The feed 105 is hydrotreated in the reactor 110 under effective hydrotreating conditions to reduce the sulfur and/or nitrogen content of the feed to a desired level. The hydrotreated effluent 115 is then passed through some type of separation stage 170, such as a stripper or a gas-liquid separation stage, in order to separate gas phase products 171 (such as contaminant gases generated during hydrotreatment) from the hydrotreated liquid effluent 117. The hydrotreated liquid effluent 117 is then passed into dewaxing stage 120. The dewaxing stage is operated under conditions effective for producing a dewaxed effluent with a cloud point that is reduced relative to the initial feedstock by at least about 40° F., such as at least about 60° F., at least about 80° F., at least about 100° F., or at least about 120° F. The dewaxed effluent 125 is then fractionated 140. The fractionator 130 generates a light ends fraction 141, one or more naphtha fractions 142, and at least one distillate fuel fraction, such as a diesel fraction. In the embodiment shown in FIG. 2, a single diesel fraction 146 is shown. Alternatively, multiple distillate fuel fractions can be formed. For example, a diesel fraction and a jet fuel fraction, both having very low cloud points, may be generated from a single feedstock.

Examples 1-3: Dewaxing of Distillate Fuel Boiling Range Feedstocks

A series of runs were performed to dewax a diesel boiling range feedstock using dewaxing catalysts with a hydrogenation metal content of 0.3 wt % and 0.6 wt %, respectively, to demonstrate the benefits of dewaxing with lower metal content. In these examples, the dewaxing catalyst used was an alumina-bound ZSM-48 catalyst with a Pt content of either 0.3 wt % or 0.6 wt %. The ZSM-48 has a silica to alumina ratio of about 70:1 to 90:1.

Example 1—Feedstock

The properties of the feedstock used in the examples are shown in Table 1.

TABLE 1

Feed Properties

| SimDis (D2887) | Feed ° F. |
|---|---|
| 0.5% | 237.9 |
| 5.0% | 371.5 |
| 10.0% | 417.8 |
| 20.0% | 467.4 |
| 30.0% | 504.3 |
| 40.0% | 535.2 |
| 50.0% | 563.2 |
| 60.0% | 588.1 |
| 70.0% | 614.5 |
| 80.0% | 646.1 |
| 90.0% | 682.4 |
| 95.0% | 709.4 |
| 99.5% | 778.2 |
| Naphtha (IBP-300° F.), wt % | 1.67 |
| Jet (300-500° F.), wt % | 27.17 |
| Diesel (500+° F.), wt % | 71.16 |
| API gravity | 35.96 |
| H Content, wt % | 13.38 |
| C Content, wt % | 86.61 |
| Cloud Point, G2500, ° F. | 21 |

In Examples 2-3, the sulfur content of the feedstock was about 10 wppm. The nitrogen content of the feed was about 47 wppm. In these examples, the total pressure in the reactor is approximately the hydrogen partial pressure.

Example 2

Table 2 shows the processing conditions and results for the dewaxing reaction performed in Example 2.

TABLE 2

Processing conditions and results for Example 2

| | Feed | 0.3 wt % Pt on ZSM-48 | 0.6 wt % Pt on ZSM-48 |
|---|---|---|---|
| Temperature, ° F. | | 629 | 630 |
| LHSV, $hr^{-1}$ | | 3 | 3 |
| Pressure, psig | | 600 | 600 |
| Treat Gas, SCF/B | | 2000 | 2000 |
| H Consumption, SCF/B | | 349 | 401 |
| Cloud Point Improvement, ° F. | | 50 | 53 |
| Naphtha (IBP-300° F.), wt % | 1.67 | 2.27 | 2.26 |
| Jet (300-500° F.), wt % | 27.17 | 29.02 | 29.22 |
| Diesel (500+° F.), wt % | 71.16 | 68.71 | 68.52 |

As shown in Table 2, at a temperature of 630° F. (332° C.) and a total pressure of 600 psig (4.1 MPag), the dewaxing catalyst with the lower metals content produced roughly the same cloud point improvement of about 50° F. (27° C.) as the cloud point improvement for the higher metals content catalyst under the same conditions. The product yields for the two catalysts were also similar. However, the hydrogen consumption for the lower metal catalyst is lower by about 12% (50 scf/B). Thus, at lower pressures the benefit achieved in reduced hydrogen consumption can be greater.

Example 3

Table 3 compares the hydrogen consumption, cloud point improvement, product color, and amount of aromatics saturation for dewaxing processes performed at a pressure of about 270 psig (1.8 MPa) and a temperature of about 630° F. (332° C.). As in Example 2, the improvement of cloud point for the two catalysts were similar, while the hydrogen consumption for the catalyst with only 0.3 wt % metal was ~25 SCF/B (4 $m^3/m^3$) lower than that for MIDW-5 catalyst. As shown in Table 3, at least part of the reduced hydrogen consumption was due to reduced aromatic saturation, as the aromatic content was about 1 wt % higher in the product from the 0.3 wt % metal dewaxing catalyst. A reduced amount of aromatic saturation could pose a concern for achieving the color specification for a diesel fuel. However, according to ASTM D-1500 test, the product colors were the same for the 0.3 wt % metal catalyst and the 0.6 wt % metal catalyst.

TABLE 3

Processing conditions and results for Example 3

| | 0.3 wt % Pt on ZSM-48 | 0.6 wt % Pt on ZSM-48 |
|---|---|---|
| Temperature,° F. | 630 | 630 |
| LHSV, $hr^{-1}$ | 3.0 | 3.0 |
| Pressure, psig | 270 | 270 |
| Treat Gas, SCF/B | 2000 | 2000 |
| H Consumption, SCF/B | 119 | 142 |
| Cloud Point Improvement,° F. | 51 | 50 |
| Product Color by ASTM D1500 | L1.5 | L1.5 |
| Aromatics, B5253/QAL | | |
| Total | 29.0 | 27.9 |
| Mono | 22.6 | 21.6 |
| PNA | 6.4 | 6.3 |

Example 4

Example 4 illustrates that a significant reduction of a cloud point temperature between a feedstock and various fractionated dewaxed effluent products can occur when the feedstock has low concentrations of sulfur and nitrogen. The feed properties are shown below in Table 4.

To demonstrate the concept of deep dewaxing, a very sweet (e.g., very low concentrations of nitrogen and sulfur) diesel-range feed containing 2.4 wppm of sulfur and <1.0 wppm of nitrogen was evaluated in a fixed-bed pilot plant at 669° F., 2.9 LHSV, 1049 pisg, and 1990 scf/b 100% hydrogen treat gas. The results demonstrate that the cloud point of the dewaxed effluent (e.g., total liquid in Table 8) was reduced from −8.7° C. of the feedstock to −74° C. or achieving 65.3° C. cloud point reduction. The jet fuel range (350-609° F.) of the total liquid product was further fractionated into four fractions to ensure that each fraction has a very low cloud point and freeze point. As shown in Table 5 below, the jet fuel range product fraction products meet the <−40° C. freeze point requirement for jet fuels. The 609° F.$^+$ diesel product also meets Class 4 arctic diesel cloud point specification, which is <−34° C. Table 6 illustrates EN590 arctic diesel classifications and specifications.

Because the feedstock contains very low levels of sulfur and nitrogen, as shown in Table 4, a high degree of cloud point reduction can be achieved. Even further, this allows for the production of both jet fuels and heavy arctic diesel fuels. The total liquid, or dewaxed effluent, can be fractionated so that a portion of the fractionated product can be sold as an arctic diesel product, and another portion can be sold as jet fuel. While typically feedstock is processed to produce only one product, here, based in part on the nitrogen and sulfur concentrations of the feedstock, multiple products can be produced simultaneously. The resulting low cloud point of the diesel product is suitable for arctic diesel applications, which requires as low as a cloud point of <−34° C.

The distillation of the feedstock may be performed according to any preferred method. In one embodiment, distillation is performed according the ASTM method D2887.

TABLE 4

Feed Properties for Example 4

| | |
|---|---|
| API Gravity | 32.9 |
| Sulfur, ppmw | 2.4 |
| Nitrogen, ppmw | <1.0 |
| Cloud Point, ° C. | −8.7 |
| Pour Point, ° C. | −12 |
| Distillation (D2887) | |
| IBP, ° F. | 487 |
| 10 wt % off, ° F. | 521 |
| 50 wt % off, ° F. | 582 |
| 90 wt % off, ° F. | 669 |
| FBP, ° F. | 757 |

TABLE 5

Detailed Product Analyses

| | Total Liquid | 350-477° F. | 477-532° F. | 532-568° F. | 568-609° F. | 609° F.$^+$ |
|---|---|---|---|---|---|---|
| API | 38.4 | 43.7 | 37.2 | 35.6 | 35.2 | 32.9 |
| Cloud Point, ° C. | −74 | −73.1 | −73.9 | −73.5 | −69.5 | −74.3 |

TABLE 5-continued

Detailed Product Analyses

| | Total Liquid | 350-477° F. | 477-532° F. | 532-568° F. | 568-609° F. | 609° F.$^+$ |
|---|---|---|---|---|---|---|
| Pour Point, ° C. | 76.4 | <−80 | <−80 | <−80 | −73 | <−80 |
| Freeze Point (estimated), ° C. | | <−40 | <−40 | <−40 | <−40 | |

TABLE 6

EN590 Arctic Diesel Specifications

| | Class 0 | Class 1 | Class 2 | Class 3 | Class 4 |
|---|---|---|---|---|---|
| CFPP Value | −20° C. | −26° C. | −32° C. | −38° C. | −44° C. |
| Cloud Point | −10° C. | −16° C. | −22° C. | −28° C. | −34° C. |

Example 5

In the example provided below, two catalysts were evaluated in a pilot plant. The two catalysts correspond to Catalyst A, which included 0.6 wt % platinum, and Catalyst B which included 0.3 wt % platinum.

The feedstock used for this example is shown in Table 7 below. Both catalysts were tested at the same conditions: 630° F., 3.0 $hr^{-1}$ liquid hourly space velocity (LHSV), 1000 psig, and 2107 scf/b 100% hydrogen treat gas. The products were fractionated into 300-500° F. jet fuel fraction and 5000° F.$^+$ diesel fraction. The analyses of the 300-500° F. jet fuel fraction and 500° F.$^+$ diesel fraction are shown in Table 8, and Table 9, respectively. Both jet fuel products meet jet fuel specification on freeze point and smoke point (Table 8). Similarly, both diesel products meet cloud point (<−10° C.) and cold filter plugging point (CFPP) (<−20° C.) for the Class 0 arctic diesel (Table 9). In addition, both diesel products are very high in cetane index and very low in PNA.

TABLE 7

Feed Properties for Example 5

| | |
|---|---|
| API Gravity | 35.96 |
| Sulfur, wppm | 10.3 |
| Nitrogen, wppm | 46.7 |
| Cloud Point, ° C. | −6 |
| Pour Point, ° C. | −10 |
| Distillation (D2887) | |
| IBP, ° F. | 237 |
| 10 wt % off | 417 |
| 50 wt % off | 545 |
| 90 wt % off | 682 |
| Final Boiling Point (FBP) | 777 |

TABLE 8

300-500° F. Jet Fuel Products Comparison

| Sample Description | Specifications | Catalyst B 0.3 wt % Pt | Catalyst A 0.6 wt % Pt |
|---|---|---|---|
| S, ppm | | <0.2 | <0.2 |
| N, ppm | | 0.8 | 0.7 |
| API gravity | | 43.26 | 43.17 |

TABLE 8-continued

| 300-500° F. Jet Fuel Products Comparison | | | |
|---|---|---|---|
| Sample Description | Specifications | Catalyst B 0.3 wt % Pt | Catalyst A 0.6 wt % Pt |
| Flash Point, D93, ° C. | <37.8 | 42.0 | 46.0 |
| Freezing Point, D5972, ° C. | <−40 or <−47 | −53.1 | −53.7 |
| Smoke Point, D1332-1, mm | >18 | 32 | 32 |
| Aromatics, B5253/QAL, wt % | | | |
| Total | | 3.1 | 2.6 |

TABLE 9

| 500° F.+ Diesel Products Comparison | | | |
|---|---|---|---|
| Sample Description | Specifications | Catalyst-B 0.3 wt % Pt | Catalyst-A 0.6 wt % Pt |
| S, ppm | 15 | 0.7 | 0.6 |
| N, ppm | | 1.7 | 1.4 |
| API gravity | | 36.37 | 36.43 |
| Cloud Point, G2500, ° C. | <−10 | −21 | −22 |
| Pour Point, G5901, ° C. | | −31 | −29 |
| CFPP, D6371, ° C. | <−20 | −22 | −23 |
| Cetane number, M1656 | 40 | 59.1 | 58.8 |
| Flash Point, D93, ° C. | >52.2 | 140 | 140 |
| Aromatics, B5253/QAL, wt % | | | |
| Total | | 7.8 | 6.8 |
| Mono | | 6.3 | 5.4 |
| PNA | | 1.5 | 1.4 |

ADDITIONAL EMBODIMENTS

Embodiment 1

A method for producing multiple distillate products from a single feedstock, the method comprising: exposing a distillate fuel boiling range feedstock having a sulfur content of less than about 10 wppm and a nitrogen content of less than about 5 wppm to a dewaxing catalyst comprising a molecular sieve and a Group VIII noble metal hydrogenation component under effective dewaxing conditions to produce a dewaxed effluent having a cloud point that is reduced by at least about 25° F. (14° C.) relative to a feedstock cloud point; and fractionating the dewaxed effluent to produce at least a diesel fuel product having a cloud point of about −4° F. (−20° C.) or less and a distillate product having a lower boiling range than the diesel fuel product, a fractionation cut point temperature between the diesel fuel product and the distillate product having the lower boiling range being at least 500° F. (260° C.).

Embodiment 2

The method of Embodiment 1, wherein the dewaxing catalyst has an amount of metal hydrogenation component comprising about 0.05 wt % to about 0.35 wt % of a Group VIII noble metal.

Embodiment 3

The method of Embodiment 1, wherein the effective dewaxing conditions comprise a pressure of from about 200 psig (1.4 MPa) to about 1500 psig (10.4 MPa), a temperature of from about 321° C. (610° F.) to about 399° C. (750° F.), a hydrogen treat gas rate of about 500 scf/bbl (84 $Nm^3/m^3$) to about 4000 scf/bbl (674 $Nm^3/m^3$) or less, and a space velocity of from about 0.3 $hr^{-1}$ to about 4.9 $hr^{-1}$.

Embodiment 4

The method of Embodiment 1, wherein the metal hydrogenation component comprises Pt, Pd, or a combination thereof.

Embodiment 5

The method of Embodiment 1, wherein the molecular sieve is a 10-member ring 1-D molecular sieve and comprises ZSM-48, ZSM-23, or a combination thereof.

Embodiment 6

The method of Embodiment 5, wherein the molecular sieve comprises ZSM-48 with a silica to alumina ratio of about 70 to 1 to about 110 to 1.

Embodiment 7

The method of Embodiment 6, wherein the molecular sieve has a silica to alumina ratio of about 90 to 1 or less.

Embodiment 8

The method of Embodiment 1, wherein the feedstock has the sulfur content of less than about 5 wppm or less and the nitrogen content of less than about 1 wppm or less.

Embodiment 9

The method of Embodiment 1, wherein the effective dewaxing conditions produce a dewaxed effluent having a cloud point that is reduced relative to a cloud point of the feedstock by at least about 80° F. (44° C.).

Embodiment 10

The method of Embodiment 1, the effective dewaxing conditions produce a dewaxed effluent having a cloud point that is reduced relative to a cloud point of the feedstock by at least about 100° F. (56° C.).

Embodiment 11

The method of Embodiment 1, wherein the distillate product is a jet fuel product having a freeze point of less than about −40° F. (−40° C.).

Embodiment 12

The method of Embodiment 1, wherein the fractionation cut point temperature between the distillate product having the lower boiling range and the diesel fuel product is at least about 545° F. (285° C.), such as 590° F. (310° C.).

Embodiment 13

The method of Embodiment 1, wherein a T5 boiling point for the diesel fuel product is at least about 550° F. (288° C.), such as 600° F. (316° C.).

Embodiment 14

The method of Embodiment 1, wherein the distillate fuel boiling range feedstock has a T5 boiling point of at least about 280° F. (140° C.).

Embodiment 15

The method of Embodiment 1, wherein the diesel fuel product has a cloud point of about −76° F. (−60° C.) or less.

Embodiment 16

The method of Embodiment 1, further comprising exposing the dewaxed effluent to a hydrofinishing catalyst under effective hydrofinishing conditions, wherein the effective hydrofinishing conditions comprise a pressure of from about 200 psig (1.4 MPa) to about 1500 psig (10.4 MPa), a temperature of from about 500° F. (260° C.) to about 750° F. (399° C.), a hydrogen treat gas rate of about 500 scf/bbl (84 $Nm^3/m^3$) to about 4000 scf/bbl (674 $Nm^3/m^3$) or less, and a space velocity of from about 0.3 $hr^{-1}$ to about 5.0 $hr^{-1}$.

Embodiment 17

A method for producing a diesel fuel product and a jet fuel product from a single feedstock, the method comprising: exposing a distillate fuel boiling range feedstock having a sulfur content of less than about 15 wppm and a nitrogen content of less than about 50 wppm to a dewaxing catalyst comprising a 10-member ring 1-D molecular sieve and a metal hydrogenation component under effective dewaxing conditions to produce a dewaxed effluent, wherein the dewaxing catalyst has an amount of metal hydrogenation component comprising about 0.05 wt % to about 0.35 wt % of a Group VIII noble metal, and wherein the dewaxed effluent, when fractionated, produces the diesel fuel product and the jet fuel product; and fractionating the dewaxed effluent to produce at least the diesel fuel product having a cloud point of about 14° F. (−10° C.) or less and the jet fuel product having a lower boiling range than the diesel fuel product, a fractionation cut point temperature between the diesel fuel product and the jet fuel product having the lower boiling range being at least 500° F. (260° C.).

We claim:

1. A method for producing multiple distillate products from a single mineral oil feedstock, the method comprising:

exposing a distillate fuel boiling range mineral oil feedstock having a boiling point range of about 200° F. to about 680° F. and a sulfur content of less than about 10 wppm and a nitrogen content of less than about 5 wppm to a dewaxing catalyst comprising a molecular sieve, wherein the molecular sieve comprises ZSM-48 with a silica to alumina ratio of 70 to 1 to about 110 to 1, and a Group VIII noble metal hydrogenation component comprising about 0.05 wt % to about 0.35 wt % of a Group VIII noble metal under effective dewaxing conditions to produce a dewaxed effluent having a cloud point that is reduced by at least about 25° F. (14° C.) relative to a feedstock cloud point; and fractionating the dewaxed effluent to produce at least a diesel fuel product having a cloud point of about −4° F. (−20° C.) or less and a jet fuel product having a lower boiling range than the diesel fuel product and having a freeze point of less than about −40° F. (−40° C.), a fractionation cut point temperature between the diesel fuel product and the jet fuel product having the lower boiling range being at least 500° F. (260° C.).

2. The method of claim 1, wherein the effective dewaxing conditions comprise a pressure of from about 200 psig (1.4 MPa) to about 1500 psig (10.4 MPa), a temperature of from about 321° C. (610° F.) to about 399° C. (750° F.), a hydrogen treat gas rate of about 500 scf/bbl (84 $Nm^3/m^3$) to about 4000 scf/bbl (674 $Nm^3/m^3$) or less, and a space velocity of from about 0.3 $hr^{-1}$ to about 4.9 $hr^{-1}$.

3. The method of claim 1, wherein the metal hydrogenation component comprises Pt, Pd, or a combination thereof.

4. The method of claim 1, wherein the molecular sieve has a silica to alumina ratio of about 90 to 1.

5. The method of claim 1, wherein the feedstock has the sulfur content of less than about 5 wppm or less and the nitrogen content of less than about 1 wppm or less.

6. The method of claim 1, wherein the effective dewaxing conditions produce a dewaxed effluent having a cloud point that is reduced relative to a cloud point of the feedstock by at least about 80° F. (44° C.).

7. The method of claim 1, wherein the effective dewaxing conditions produce a dewaxed effluent having a cloud point that is reduced relative to a cloud point of the feedstock by at least about 100° F. (56° C.).

8. The method of claim 1, wherein the fractionation cut point temperature between the distillate product having the lower boiling range and the diesel fuel product is at least about 545° F. (285° C.).

9. The method of claim 1, wherein a T5 boiling point for the diesel fuel product is at least about 550° F. (288° C.).

10. The method of claim 1, wherein the distillate fuel boiling range feedstock has a T5 boiling point of at least about 280° F. (140° C.).

11. The method of claim 1, wherein the diesel fuel product has a cloud point of about −76° F. (−60° C.) or less.

12. The method of claim 1, further comprising exposing the dewaxed effluent to a hydrofinishing catalyst under effective hydrofinishing conditions, wherein the effective hydrofinishing conditions comprise a pressure of from about 200 psig (1.4 MPa) to about 1500 psig (10.4 MPa), a temperature of from about 500° F. (260° C.) to about 750° F. (399° C.), a hydrogen treat gas rate of about 500 scf/bbl (84 $Nm^3/m^3$) to about 4000 scf/bbl (674 $Nm^3/m^3$) or less, and a space velocity of from about 0.3 $hr^{-1}$ to about 5.0 $hr^{-1}$.

13. A method for producing a diesel fuel product and a jet fuel product from a single mineral oil feedstock, the method comprising:

exposing a distillate fuel boiling range mineral oil feedstock having a boiling point range of about 200° F. to about 680° F. and a sulfur content of less than about 15 wppm and a nitrogen content of less than about 50 wppm to a dewaxing catalyst comprising a 10-member ring 1-D molecular sieve, wherein the molecular sieve comprises ZSM-48 with a silica to alumina ratio of 70 to 1 to about 110 to 1, and a metal hydrogenation component under effective dewaxing conditions to produce a dewaxed effluent, wherein the effective dewaxing conditions comprise a pressure of from about 200 psig (1.4 MPa) to about 1500 psig (10.4 MPa), wherein the dewaxing catalyst has an amount of metal hydrogenation component comprising about 0.05 wt % to about 0.35 wt % of a Group VIII noble metal, and wherein the dewaxed effluent, when fractionated, produces the diesel fuel product and the jet fuel product; and fractionating the dewaxed effluent to produce at least the diesel fuel product having a cloud point of about 14° F. (−10° C.) or less and the jet fuel product having a lower boiling range than the diesel fuel product and having a freeze point of less than about −40° F. (−40° C.), a fractionation cut point temperature between the diesel fuel product and the jet fuel product having the lower boiling range being at least 500° F. (260° C.).

14. The method of claim 1, wherein the mineral oil feedstock has a boiling point range of about 200° F. to about 650° F.

15. The method of claim 13, wherein the effective dewaxing conditions comprise a temperature of from about 321° C. (610° F.) to about 399° C. (750° F.), a hydrogen treat gas rate of about 500 scf/bbl (84 $Nm^3/m^3$) to about 4000 scf/bbl (674 $Nm^3/m^3$) or less, and a space velocity of from about 0.3 $hr^{-1}$ to about 4.9 $hr^{-1}$.

16. The method of claim 13, wherein the mineral oil feedstock has a boiling point range of about 200° F. to about 650° F.

17. A method for producing multiple distillate products from a single feedstock, the method comprising:

exposing a distillate fuel boiling range feedstock having a boiling point range of about 200° F. to about 680° F. and a sulfur content of less than about 10 wppm and a nitrogen content of less than about 5 wppm to a dewaxing catalyst comprising a molecular sieve, wherein the molecular sieve comprises ZSM-48 with a silica to alumina ratio of 70 to 1 to about 110 to 1, and a Group VIII noble metal hydrogenation component comprising about 0.05 wt % to about 0.35 wt % of a Group VIII noble metal under effective dewaxing conditions to produce a dewaxed effluent having a cloud point that is reduced by at least about 25° F. (14° C.) relative to a feedstock cloud point, wherein the effective dewaxing conditions comprise a pressure of from about 200 psig (1.4 MPa) to about 1500 psig (10.4 MPa); and fractionating the dewaxed effluent to produce at least a diesel fuel product having a cloud point of about −7.6° F. (−22° C.) or less and a jet fuel product having a lower boiling range than the diesel fuel product and having a freeze point of less than about −40° F. (−40° C.), a fractionation cut point temperature between the diesel fuel product and the jet fuel product having the lower boiling range being at least 500° F. (260° C.).

* * * * *